United States Patent [19]

Roper

[11] Patent Number: 4,852,943

[45] Date of Patent: Aug. 1, 1989

[54] PEDESTAL CHAIRS

[75] Inventor: Lewis P. Roper, Cambridge, England

[73] Assignee: PHR Furniture Limited, Cambridge, England

[21] Appl. No.: 167,002

[22] Filed: Mar. 10, 1988

[30] Foreign Application Priority Data

Mar. 14, 1987 [GB] United Kingdom ..... 8706129

[51] Int. Cl.[4] ..... A47C 3/00

[52] U.S. Cl. ..... 297/302; 297/304; 297/325

[58] Field of Search ..... 297/300, 301, 302, 303, 297/304, 305, 329, 326

[56] References Cited

U.S. PATENT DOCUMENTS

| | | | |
|---|---|---|---|
| 293,139 | 2/1884 | Bohlig | 297/302 X |
| 804,658 | 11/1905 | Hastings | 297/302 X |
| 1,678,668 | 7/1928 | Collier | 297/303 |
| 1,875,500 | 9/1932 | Roeder | 297/302 X |
| 4,013,257 | 3/1977 | Paquette | 297/304 X |
| 4,575,151 | 3/1986 | Edstrom | 297/325 X |

FOREIGN PATENT DOCUMENTS

| | | | |
|---|---|---|---|
| 79530 | 5/1983 | European Pat. Off. | 297/325 |
| 482529 | 3/1938 | United Kingdom | 297/303 |

*Primary Examiner*—Peter A. Aschenbrenner
*Assistant Examiner*—Thomas A. Rendos
*Attorney, Agent, or Firm*—Lee & Smith

[57] ABSTRACT

A pedestal chair has a chassis with a mounting block (16) mounted on the pedestal, a main frame (18) supporting the upholstered seat and back and an intermediate member (20). The block (16) and the intermediate member (20) are pivotally connected about a transverse horizontal axis (22), and the intermediate member (20) is pivotally connected to the main frame (18) about a transverse horizontal axis (28). Blocks of resiliant material (26,32) urge the main frame (18) to a datum position from which it can pivot either forwardly about the rear axis (22) or rearwardly about the forward axis (28), on dependence upon the weight distribution on the chair. (FIG. 2).

7 Claims, 6 Drawing Sheets

PEDESTAL CHAIRS

FIELD OF THE INVENTION

This invention relates generally to a pedestal chair and is especially concerned with the mounting of the chair chassis to the pedestal.

BACKGROUND OF THE INVENTION

Pedestal chairs are known in which the chair chassis, to which the seat and back of the chair are attached, is mounted on the pedestal through a mounting which defines a pivot axis about which limited forward or rearward tilting of the chassis is permitted, in dependence on the weight distribution of the user.

THE INVENTION

According to the invention, there is provided a pedestal chair having a pedestal supporting a chair chassis to which the chair seat and chair back are attached, wherein the chair chassis is mounted on the pedestal for limited pivotal movement, in dependence on the weight distribution of the chair user, about either or both of two generally horizontal axes spaced apart in the front back direction of the chair.

The known pedestal chair is disavantageous in that the single axis of pivoting, wherever positioned, cannot be ideally suited to both forward and rearward tilting from the point of view of the user. The present invention is able to overcome this problem by providing two spaced axes about which pivotal movement of the chair chassis relative to the pedestal can occur.

The chair chassis preferably comprises parts which restrict its pivotal movement to tilting from a datum position in one sense about one axis and in the opposite sense about the second axis. Most conveniently, forward tilting is primarily effected about the more rearward axis and rearward tilting is primarily effected about the more forward axis.

In an embodiment, the chasis comprises three parts constituted by a pedestal mounting block, a main frame to which the seat and back of the chair are attachable and an intermediate member, the chassis also including interconnection means through which the main frame and the intermediate member are normally caused to assume a datum position relative to the mouting block and rearward tilting about the more foward axis is permitted by movement of the main frame relative to the mounting block and intermediate member, and forward tilting about the more rearward axis is permitted by movement of the seat frame and intermediate member relative to the mounting block. For this purpose, the intermediate member is preferably pivotally connected to the main frame is pivotally connected to the intermediate member at the more forward axis.

The interconnecting means may conveniently include respective resilient devices of which one said device is compressed with rearward tilting and one is compressed with forward tilting. The said resilient devices can for example comprise blocks of rubber or resilient plastics material.

The interconnecting means may also include a link rod interconnecting the mounting block and the intermediate member along which the intermediate member can slide by compression of the corresponding resilient block and a second linkage rod interconnecting the intermediate member and the main frame and along which the main frame can slide by compression of the corresponding other resilient block.

In a preferred arrangement, the more rearward pivot axis substantailly intersects the substantially vertical centre axis of the pedestal and the more forward axis lies substantially at the front endge of the chair chassis.

Conveniently, means may be provided whereby the resilience of at least the resilient device controlled rearward tilting is adjustable. Such adjusting means can comprise means for effecting a variable pre-compression of the resilient block.

BRIEF DESCRIPTION OF DRAWINGS

The invention is exemplified in the following description of a pedestal chair, making reference to the accompanying drawings in which.

DESCRIPTION OF THE EMBODIMENT

Figure 1:
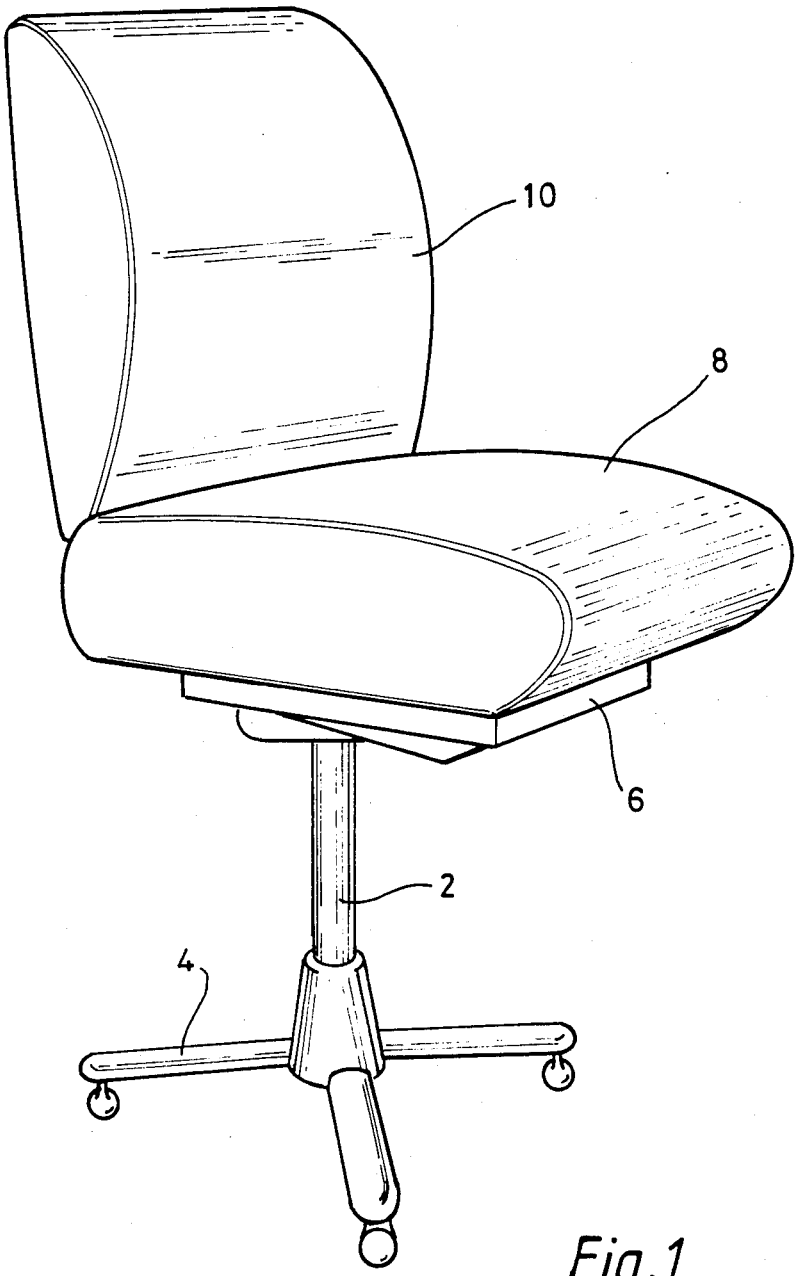
FIG. 1 is a perspective view of the chair.

Referring to the drawings, the pedestal chair in accordance with the invention comprises a pedestal 2, support feet 4, a chassis 6 supported by the upper end of the pedestal 2 an upholstered seat 8 attached to the chassis 6 and an upholstered back 10.

The chassis 6 comprises a mounting block 16 fixedly attached to the pedestal 2, a main frame 18 having attachment points for connection of the seat 8, and an intermediate member 20.

The mounting block 16 and the intermediate member 20 are pivotally connected at the pivot axis 22 and are relatively shaped so that the intermediate member 20 is normally urged into a datum position relative to the mounting block 16, by means of a resilient urethane block 26 surrounding a linkage rod 245. The main frame 18 is pivotally connected to the intermediate member 20 at the pivot axis 28 and these parts are relatively shaped so that the main frame is normally urged into a datum position relative to the intermediate member and thus relative to the mounting block 16 by means of a resilient urethane block 32 surrounding a rod 30.

It will be noted that the pivot axis 22 is a horizontal pivot axis spaced rearwardly of the also horizontal pivot axis 28, the rearward axis 22 intersecting the central axis of the pedestal and the forward axis 28 being at the front edge of the chair chassis. These axes are shown in dotted lines in FIG. 6.

Figure 2:
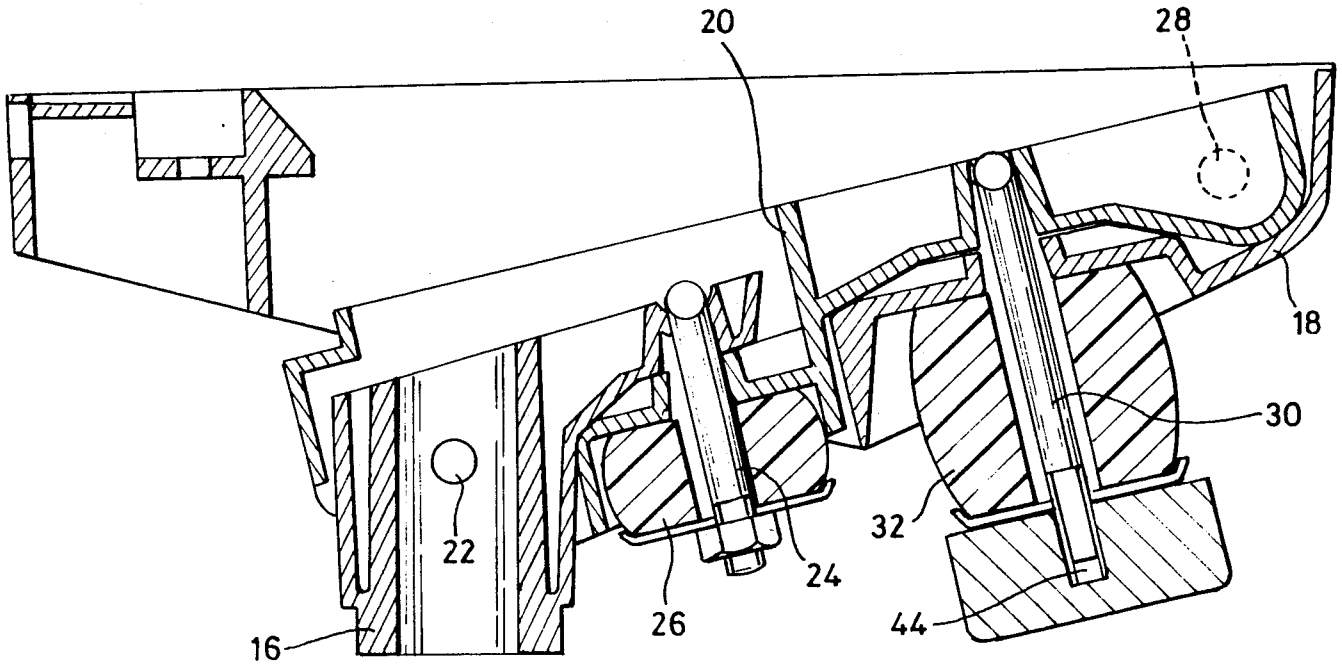
FIG. 2 is a vertical cross-section through a chair chassis, in the front to back direction of the chair, showing the chassis in its normal or datum position.
Figure 3:
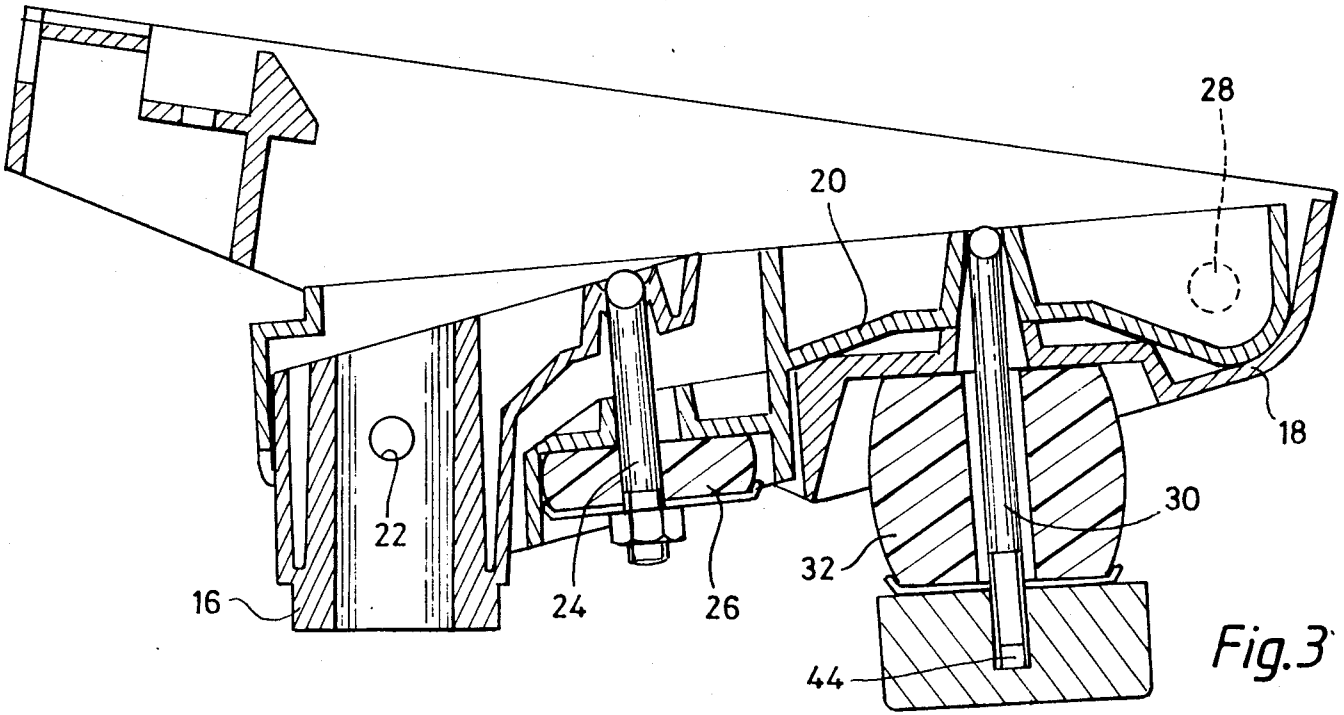
FIG. 3 is a similar cross-section showing the chair chassis in a forwardly tilted condition.
Figure 4:
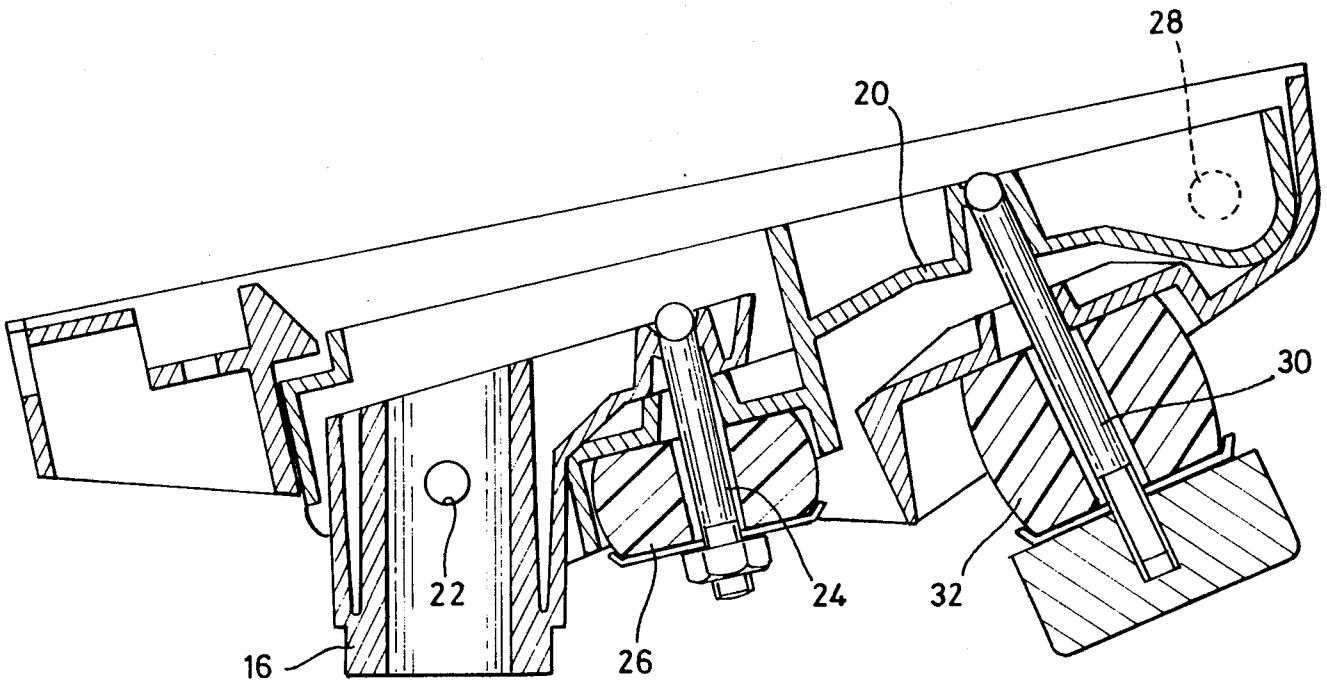
FIG. 4 is a similar cross-section showing the chair chassis in a condition of maximum rearward tilt.
Figure 5:
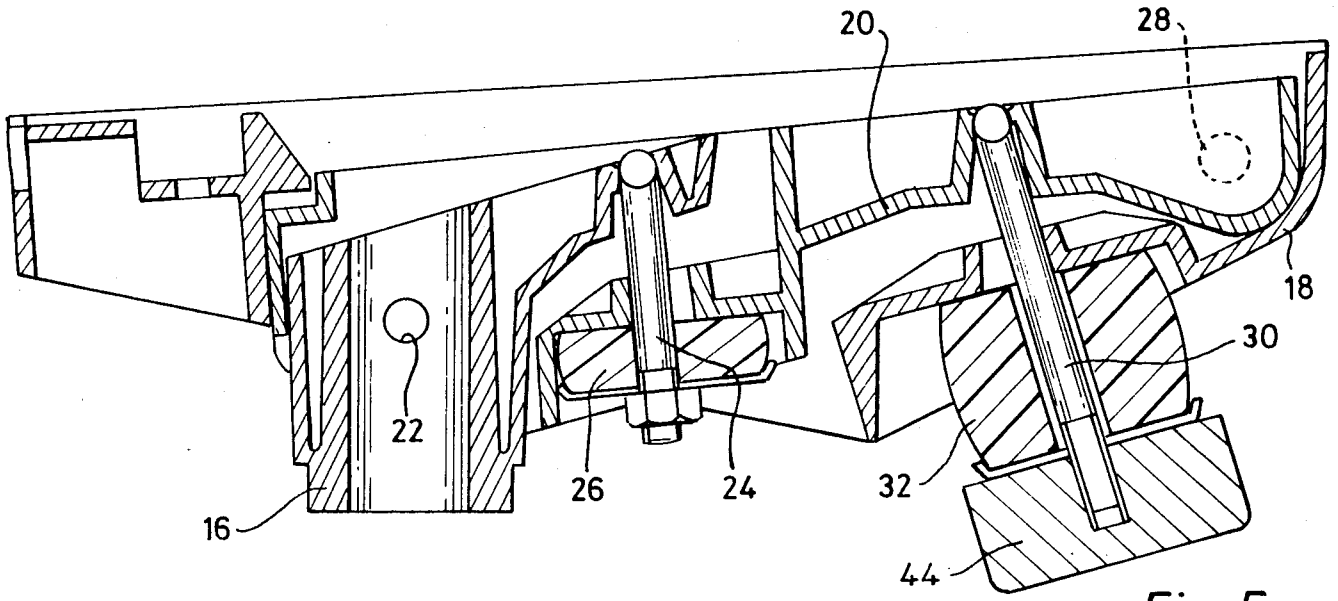
FIG. 5 is a view similar to that of FIG. 3 but with the chair chassis in a position of lesser rearward tilt.

FIG. 2 shows the parts of the chair chassis in the datum position which the chassis assumes when the chair is not in use. FIGS. 3 to 5 show the relative positions assumed by the part of the chair chassis when the chair is in use and the distribution of the weight of the user causes the chair to be forwardly or rearwardly tilted.

Referring first to FIG. 3 when the user causes maximum weight to be applied at the front of the chair seat, forward tilting is produced about the more rearward pivot axis 22. This is enabled by forward (clockwise as shown in FIG. 3) tilting of the main frame 18 and intermediate compression of the resilient block 26 as the intermediate movement along the linkage rod 24.

Turning now to FIG. 4, there is shown the condition of maximum rearward tilt enabled by pivotal movement (anticlockwise as shown) of htemaind frame 18 relative to the intermediate member about the pivot axis 28. When the user applies pressure tothe back of teh chair, the intermediate member 20 is unable to separate from the mounting block 16, but pivotal movement of the-main frme is permitted as it slides along the linkage rod 20, accompanied by compression of the resilient block 32.

Finally, FIG. 5 shows a position of lesser rearward tilt occasioned when the weight distribution of the user is such that a maximum thrust is applied to the seat at a position between the more reareward and more forward pivot axes 22, 28. This minimal rearward tilt requires a combination of the relative movements of the chassis parts previously described with reference to FIGS. 2 and 3. Thus, in FIG. 5, both resilient blocks 26, 32 are compressed.

Figure 6:
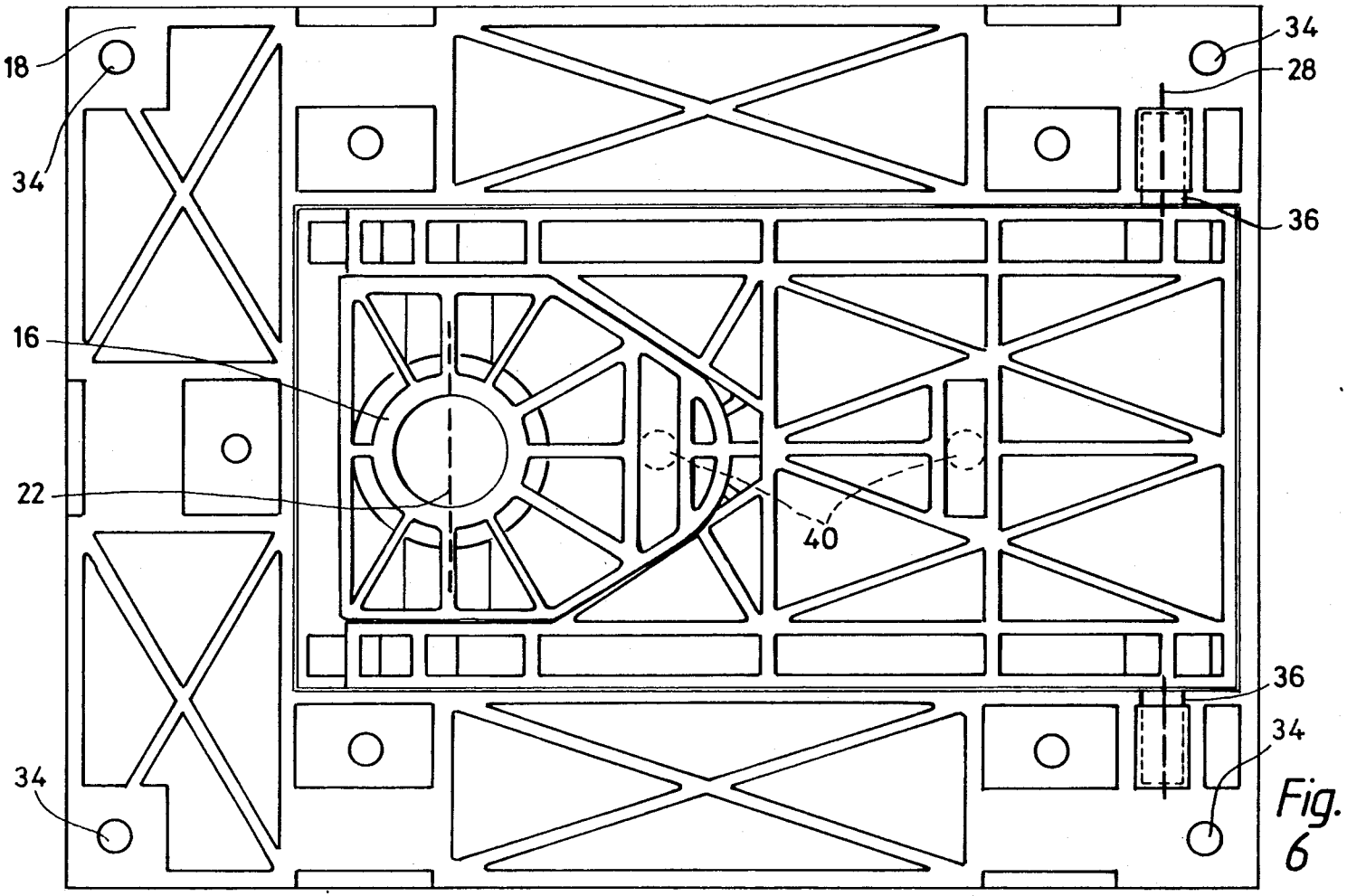
FIG. 6 is a plan view of the chair chassis.

In plan view (FIG. 6), the intermediate member 20 has a rectangular outline and is surrounded by the main frame 18 which has four attachement bosses 34 for securing the frame 18 to the seat. FIG. 6 also shows the top of the mounting block 16 and the spaced horizontal axes 22, 28. The intermediate member 20 has projecting stube pivots 36 which are received in bearings formed on the main frame 18 to define the pivot axis 28. Similarly, the block 16 carries oppositely projecting stub pivots (not shown) received on bearings on the intermediate member 20, to define the pivot axis 22.

References 40 in FIG. 6 denote anchorages for the upper ends of the linkage rods 24, 30.

The parts 16, 18 and 20 of the chair chassis are pressed or stamped metal parts or preformed mouldings.

Referring back to FIG. 2, the reference 44 denotes a screw adjuster for the compression blcok 32. The adjuster 32 is used to pre-compress the block 32 in order to ajust the return spring force.

I claim:

1. A pedestal chair having a pedestal supporting a chair chassis to which a chair seat and a chair back are attached, wherein the chair chassis is mounted on the pedestal for limited pivotal movement, in dependence on the weight distribution of the chair user, about either or both of two generally horizontal axes spaced apart in the front back direction of the chair, wherein the chair chassis comprises three parts which restrict its pivotal movement to tilting from a datum position in one sense about one axis and in the opposite sense about the second axis, and wherein said three parts are constituted by a pedestal mounting block, a main frame to which the seat and back of the chair are attachable and an intermediate member, the chassis also including interconnecting means through which the main frame and the intermediate member are normally caused to assume a datum position relative to the mounting block and rearward tilting about the more forward axis is permitted by movement of the main frame relative to the mounting block and intermediate member, and forward tilting about the more rearward axis is permitted by movement of the seat and intermediate member relative to the mounting block.

2. A pedestal chair according to claim 1, wherein the intermediate member is pivotally connected to the mounting block at the more rearward axis and the main frame is pivotally connected to the intermediate member at the more forward axis.

3. A pedestal chair according to claim 1, wherein the interconnecting means includes respective resilient devices of which one said device is compressed with rearward tilting and one is compressed with forward tilting.

4. A pedestal chair according to claim 3, wherein the resilient devices comprise blocks of resilient material.

5. A pedestal chair according to claim 4, wherein the interconnecting means also include a link rod which interconnects the mounting block and the intermediate member and along which the intermediate membe can slide by compression of the corresponding resilient block, and a second linkage rod which interconnects the intermediate member and the main frame and along which the main frame can slide by compression of the corresponding other resilient block.

6. A pedestal chair according to claim 3 wherein means are provided whereby the resilience of at least the resilient device controlling rearward tilting is adjustable.

7. A pedestal chair according to claim 1, wherein the more rearward pivot axis substantially intersects a substantially vertical central axis of the pedestal and the more forward axis lies substantially at the front edge of the chair chassis.

* * * * *